US006266020B1

(12) United States Patent
Chang

(10) Patent No.: US 6,266,020 B1
(45) Date of Patent: Jul. 24, 2001

(54) HIDDEN ANTENNA DEVICE OF A MOBILE PHONE

(75) Inventor: Daniel Chang, Pa-Te (TW)

(73) Assignee: Auden Technology Mfg. Co. Ltd., Pa-Te (TW)

( * ) Notice: Subject to any disclaimer, the term of this patent is extended or adjusted under 35 U.S.C. 154(b) by 0 days.

(21) Appl. No.: 09/624,352

(22) Filed: Jul. 24, 2000

(51) Int. Cl.[7] ..... H01Q 1/24
(52) U.S. Cl. ..... 343/702
(58) Field of Search ..... 343/702, 700, 343/700 MS; H01Q 1/24

(56) References Cited

U.S. PATENT DOCUMENTS 6,195,049 * 2/2001 Kim et al. ..... 343/702

* cited by examiner

*Primary Examiner*—Michael C. Wimer
(74) *Attorney, Agent, or Firm*—Dougherty & Troxell

(57) ABSTRACT

A hidden antenna device of a mobile phone, the mobile phone is comprised of an upper cover and a lower cover, a main electric circuit board is provided in the interior space formed by the two members. The lower cover has an antenna circuit printed at a suitable position on the inner bottom surface of the lower cover; the antenna circuit has a protruding end connecting point. A main electric circuit board in the body of the phone has on the rear surface thereof another connecting point in opposition to the aforesaid end connecting point. A ceramic layer and a matching electric circuit board layer having a desired frequency are provided between the antenna circuit and the main electric circuit board, so that when the upper cover and the lower cover are assembled, the connecting points connect with each other to form the antenna device which has no any exposed member to the exterior of the mobile phone.

3 Claims, 5 Drawing Sheets

HIDDEN ANTENNA DEVICE OF A MOBILE PHONE

BACKGROUND OF THE INVENTION

1. Field of the Invention

The present invention is related to a hidden antenna device of a mobile phone, and especially to an antenna device of which the antenna is directly provided in the interior of the mobile phone to thereby save the out- extending portion of the antenna.

2. Description of the Prior Art

A mobile phone is a communication instrument carriable on one's person, it is not connected with a conductor normally, and is powered by batteries. Thereby it must transmit and receive signals by aiding of an antenna.

Conventional mobile phones available now are divided into a fixed and a stretchable type no matter they are of the kind with single frequency or two frequencies. The fixed type directly has its antenna rod with an internal inductive coil fixed on the top of the body of the phone. While the stretchable type normally has the antenna separated into multiple sections to be pull to stretch out when in use and to be pushed to contract back into the body of the phone when not in use. Whichever the style of structure of the antenna is used, a predetermined length of it is protruded from the top of the body of the phone, this not only is inconvenient for carrying, but also makes its mobile phone difficult to be miniaturized.

Mobile phones have been being gradually popularized in the recent years, there have been quite a lot of improvements in design of mobile phones, some gave improvements in the structure of the antennae of mobile phones, some in the structure of the connector of the antennae of mobile phones, most of them are related to improved structure of the accessories for transmitting or receiving signals or related accessories of antennae for assembling the antennae, the defect stated above of an antenna in protruding from the top of the body of a mobile phone has not yet been gotten rid of.

And more, the antennae available presently generally shall suit 900 MHZ and 1800 MHZ, however, under the tendency that mobile phones get more and more miniaturized, it is generally not ideal to use an antenna for the low frequency 900 MHZ.

SUMMARY OF THE INVENTION

The object of the present invention is to provide a hidden antenna device of a mobile phone, the antenna is provided in the body of the phone, there is no any exposed member of the antenna to the exterior of the phone. This is most suitable for carrying and for being miniaturized of the mobile phone.

To obtain this object, the present invention is directly provided in the bottom surface of the rear housing (where the electric circuit board is) of the main body of the mobile phone with a printed electric circuit for the antenna. The printed electric circuit for the antenna electrically connected with the connecting points on the electric circuit board on the main body through the essential interlayers of air, ceramics and a matching electric circuit board to form a hidden antenna device of a mobile phone without any exposed member of the antenna.

The electric circuit for the antenna in the bottom surface of the rear housing stated above can be a low frequency (900 MHZ) electric circuit for transmitting and receiving signals. While the matching electric circuit board can be a high frequency (1800 MHZ) electric circuit for the antenna matchable with the low frequency (900 MHZ) electric circuit, and is provided with a plurality of connecting points to connect respectively with the electric circuit board of the main body and the printed electric circuit for the antenna in the bottom surface of the rear housing. The low frequency electric circuit for the antenna in the bottom surface of the rear housing owns a larger distributing area; thereby it has superior signal transmitting and receiving function.

The present invention will be apparent in its novelty and other characteristics after reading the detailed description of the preferred embodiment thereof in reference to the accompanying drawings.

DETAILED DESCRIPTION OF THE PREFERRED EMBODIMENT

Figure 1:
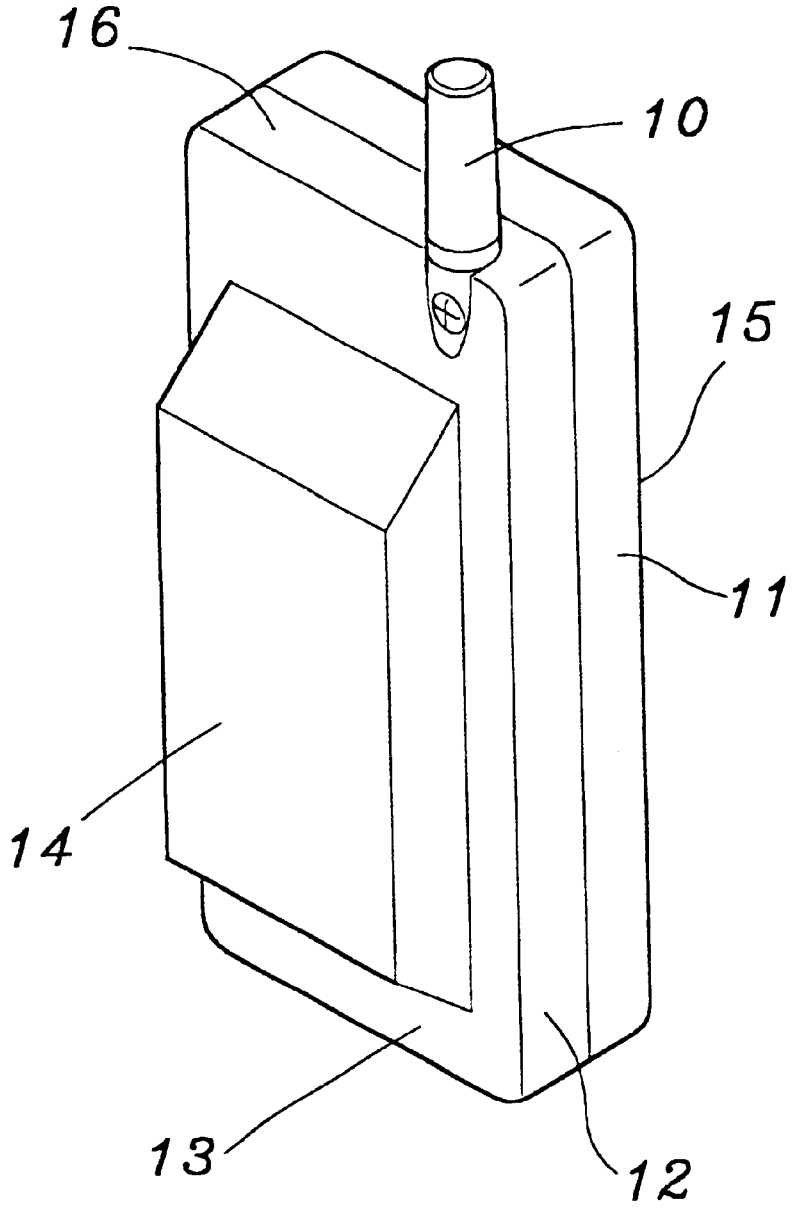
FIG. 1 PRIOR ART
FIG. 1 is a perspective view showing a conventional antenna device of a mobile phone.

Referring to FIG. 1 which shows the rear side of a mobile phone using a fixed antenna 10, the main body thereof is comprised mainly of an upper cover 11 and a lower cover 12. The lower cover 12 is provided on the rear surface 13 thereof with batteries 14. The upper surface 15 of the upper cover 11 is provided certainly a screen area and a push button control area which are not shown. Such a fixed antenna 10 used on the mobile phone must have the fixed antenna 10 exposed out from the top surface 16 of the mobile phone, so that the total length of the mobile phone is increased, and thereby, it is difficult to have the mobile phone miniaturized. And the defect stated above, i.e., the antenna protrudes from the top of the body of the phone to make it inconvenient for carrying, is induced, and this is not further narrated herein.

Figure 2:
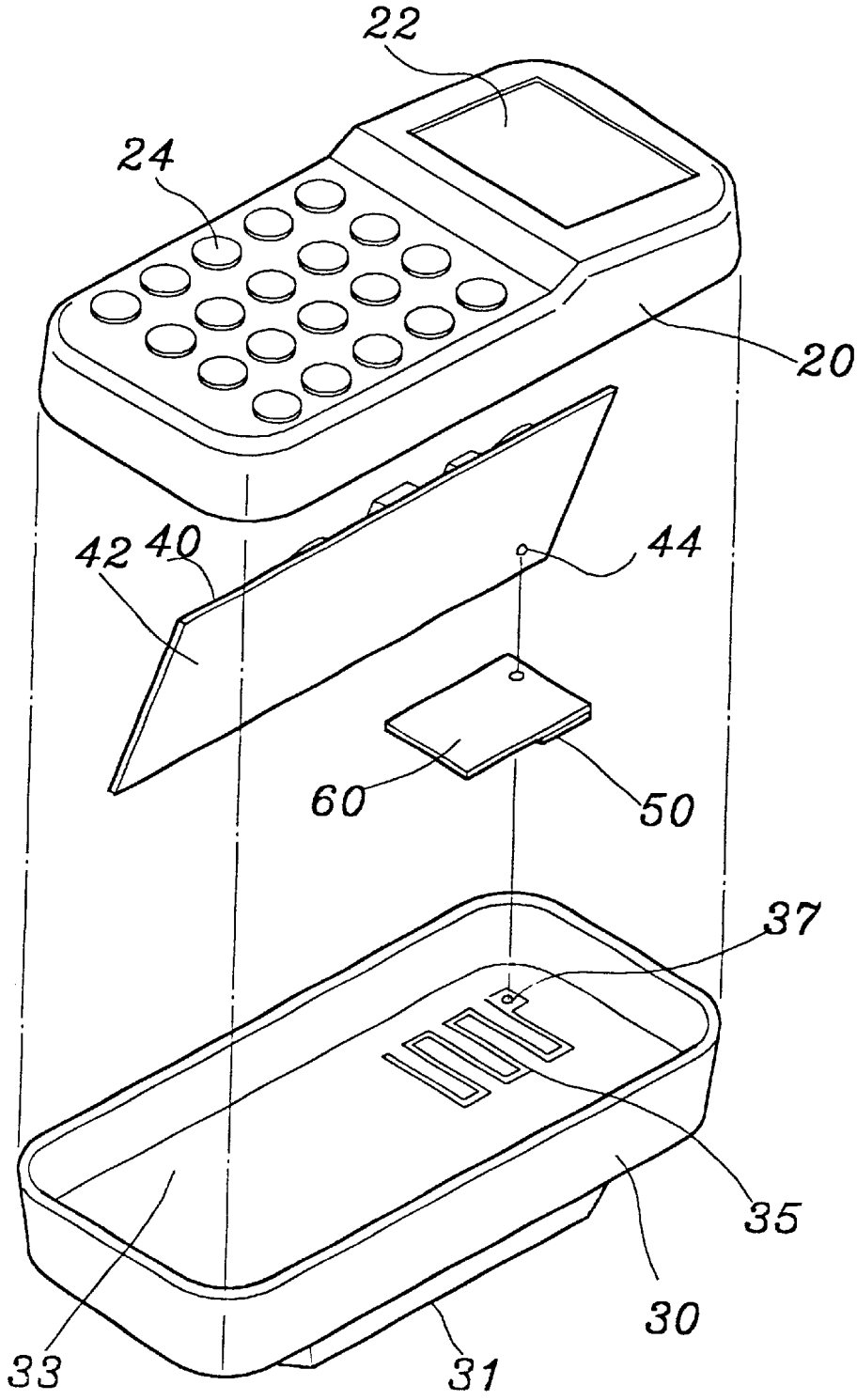
FIG. 2 is an analytic perspective view showing a preferred embodiment of the present invention.
Figure 3:
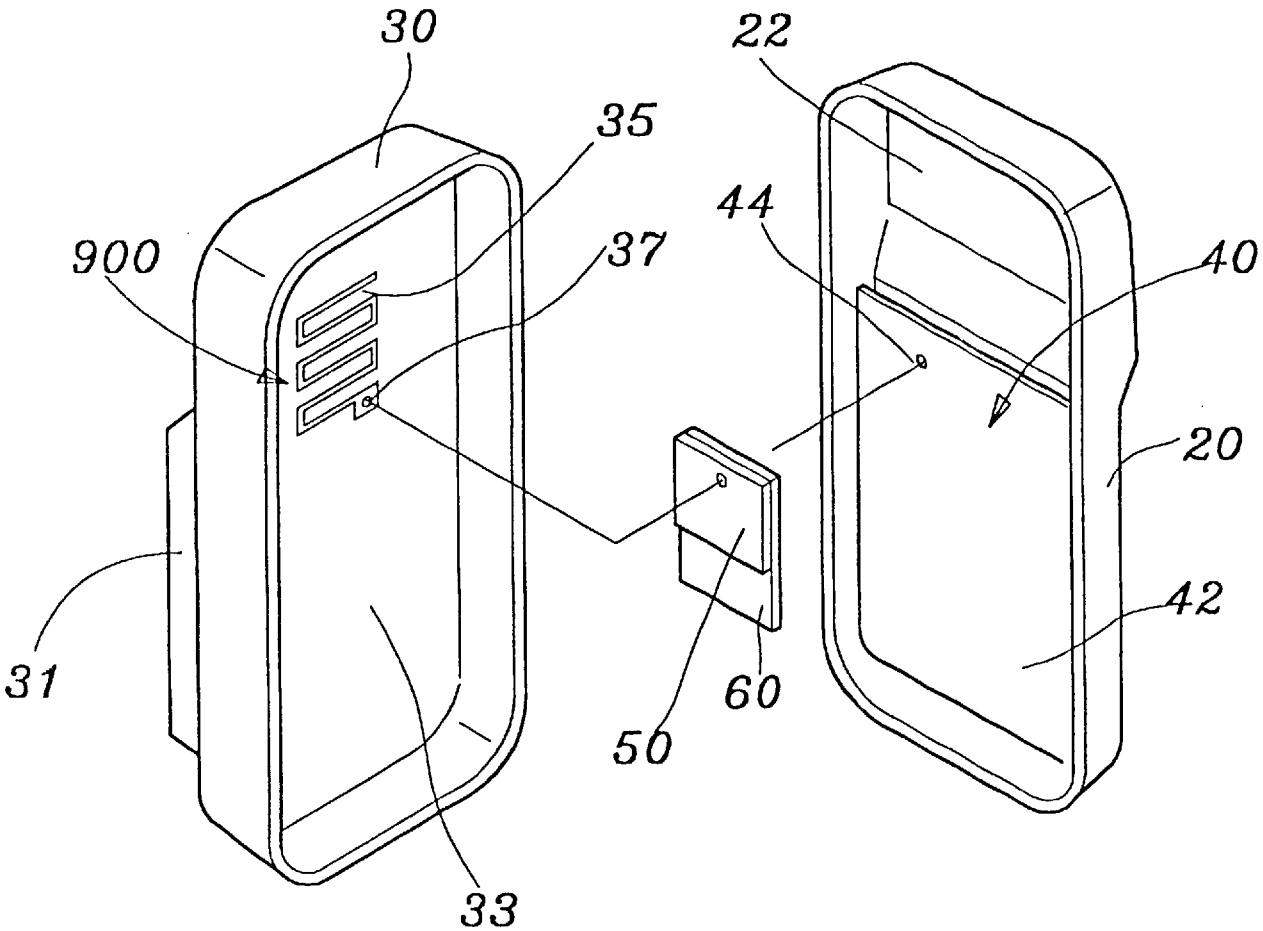
FIG. 3 is an analytic perspective view showing the preferred embodiment of FIG. 2 in another point of view.
Figure 4:
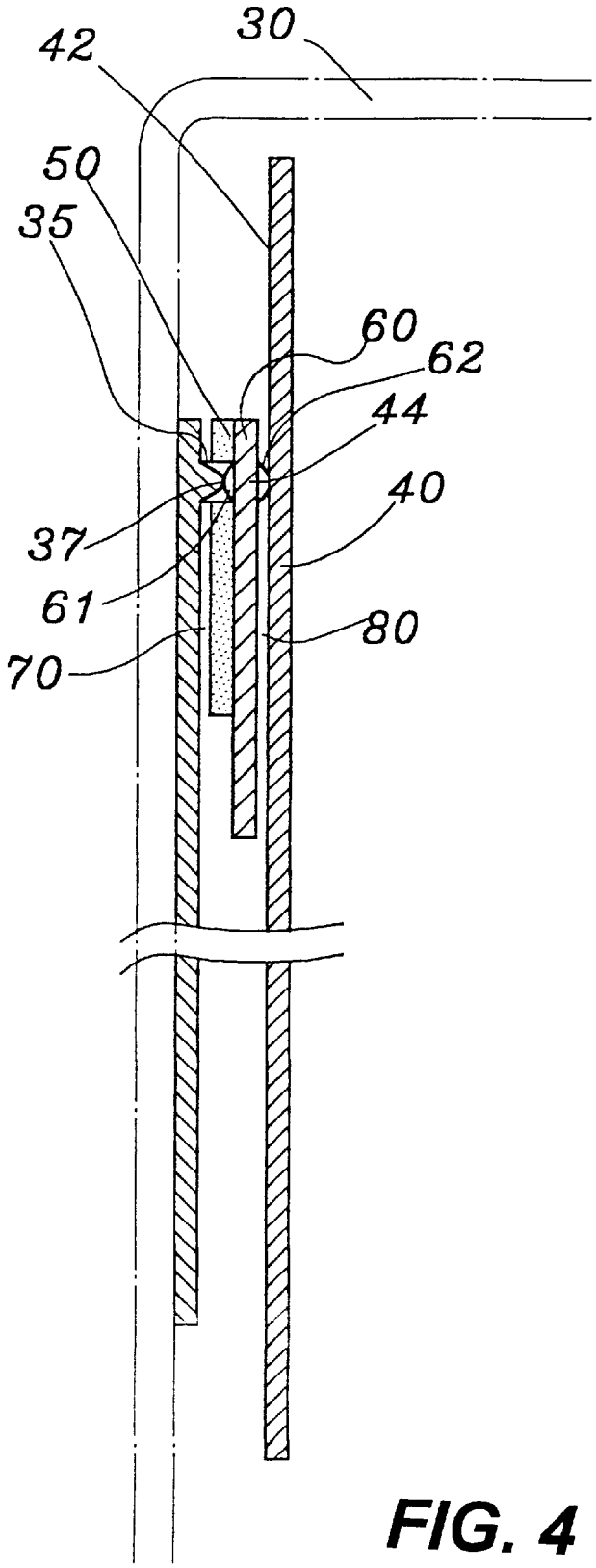
FIG. 4 is a sectional view showing assembling of the embodiment shown in FIG. 2.

Referring to FIGS. 2–4, the main body of the mobile phone is also comprised mainly of an upper cover 20 and a lower cover 30, and certainly an essential main electric circuit board 40 is provided in the interior space formed by the two members. The external surface of the upper cover 20 is also provided with a screen area 22 and a push button control area 24. The lower cover 30 is mounted on the rear surface thereof with batteries 31.

The present invention is characterized by that, an antenna circuit 35 can be printed at a suitable position on the inner bottom surface 33 of the lower cover 30, the antenna circuit 35 is provided with a protruding end connecting point 37. The antenna circuit 35 is preferably a low frequency (900 MHZ) signal transmitting and receiving electric circuit. By virtue that the inner bottom surface 33 of the lower cover 30 has a larger area than that of an ordinary exterior antenna, an excellent low frequency (900 MHZ) signal transmitting and receiving electric circuit can thus be formed. The main electric circuit board 40 in the body of the phone is provided on the rear surface 42 thereof with another connecting point 44 in opposition to the end connecting point 37, these points can be connected with each other when the upper cover 20 and the lower cover 30 are assembled, thereby, the antenna circuit 35 become a common antenna also for the main electric circuit board 40.

In the preferred embodiment shown, the connecting points 37, 44 can be mounted therebetween a ceramic layer 50 and a matching electric circuit board layer 60, these two layers 50, 60 can be connected integrally. The ceramic layer 50 faces to the inner bottom surface 33, while the matching electric circuit board layer 60 is preferably kept a space from the main electric circuit board 40 to form air interlayers 70, 80.

In structure of the above stated embodiment, the matching electric circuit board layer 60 is provided respectively on the two sides thereof with connecting points 61, 62, wherein, the connecting point 61 can be electrically connected with the connecting point 37 on the inner bottom surface 33 of the lower cover 30 when the essential members are in positions, and the other connecting point 62 can be electrically connected with the other connecting point 44 of the main electric circuit board 40.

Figure 5:
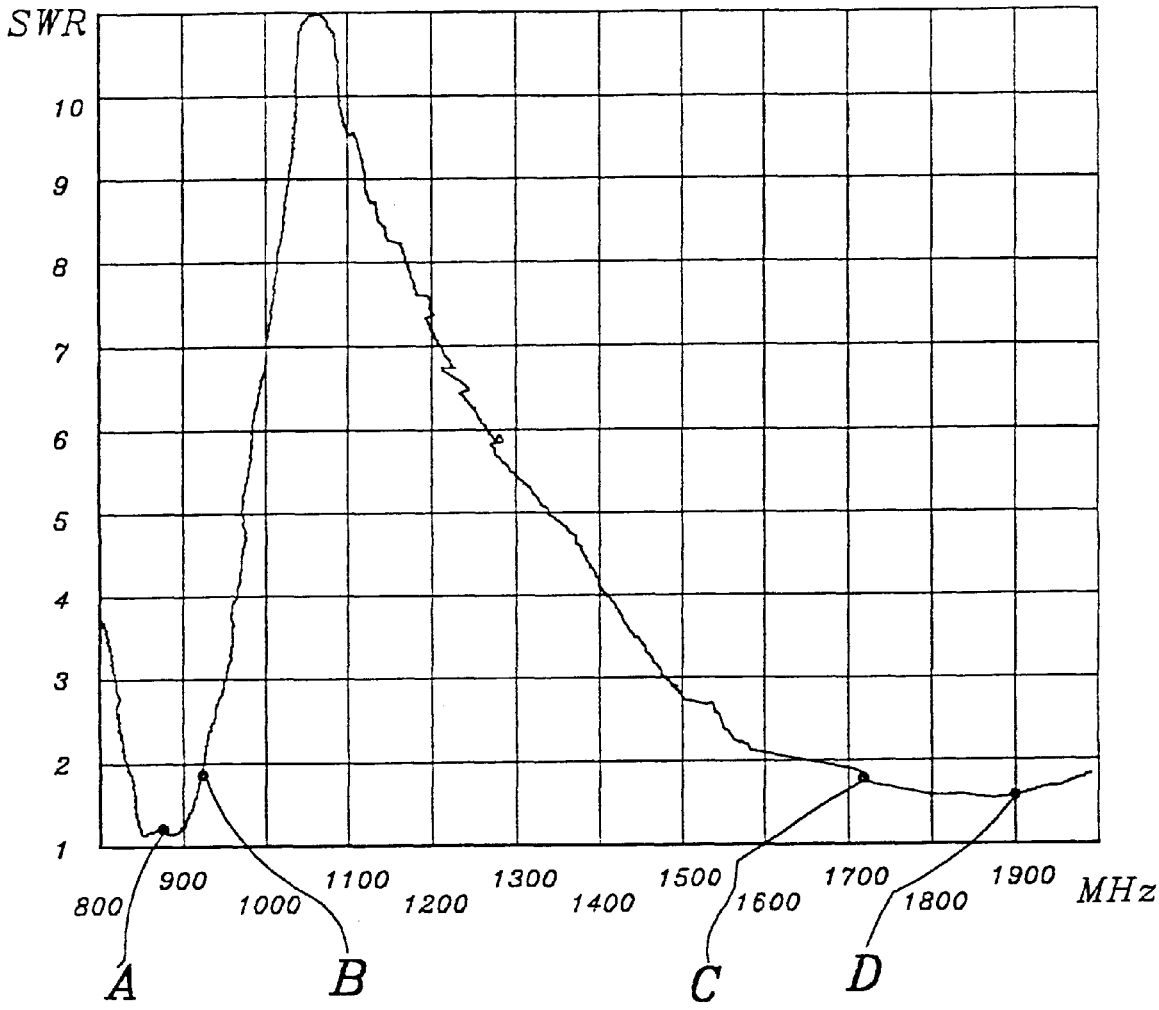
FIG. 5 is a test chart for the present invention, wherein, the longitudinal ordinate indicates standing wave ratios, while the transverse ordinate indicates frequencies.

As shown in FIG. 5, when a sample of the present invention is under testing, provided that the test value of frequency is 890–915 MHZ at A, 935–960 MHZ at B, 1710–17855 MHZ at C and 1805–1880 MHZ at D, these test values of frequencies are low frequencies (such as 900 MHZ) and high frequencies (such as 1800 MHZ) used normally. From the test chart, we can see that the standing wave ratios (SWR) of the four points A, B, C and D are all under the value 2, function thereof is quite ideal.

In the present invention, the above stated structure can completely hide the antenna in the main body of the mobile phone; there is no any exposed member of the antenna to the exterior of the phone. It is suitable for carrying and is able to render the mobile phone miniaturized, thus it is surely industrial valuable.

The preferred embodiment cited above is only for illustrating and not for giving any limitation to the scope of the present invention. It will be apparent to those skilled in this art that various modifications or changes can be made to the elements of the present invention without departing from the spirit and scope of this invention. Accordingly, all such modifications and changes also fall within the scope of the appended claims and are intended to form part of this invention.

What is claimed is:

1. A hidden antenna device of a mobile phone, said mobile phone is comprised of an upper cover and a lower cover, a main electric circuit board is provided in the interior space formed by said upper cover and lower covers, said antenna device is characterized by: said lower cover has an antenna circuit printed on the inner bottom surface of said lower cover; said antenna circuit has a first protruding end connecting point, said main electric circuit board in the body of said mobile phone has on the rear surface thereof another connecting point in opposition to said first end connecting point, a ceramic layer and a matching electric circuit board layer having a desired frequency are provided between said antenna circuit and said main electric circuit board, when said upper cover and said lower cover are assembled, said connecting points connect with each other.

2. A hidden antenna device of a mobile phone as defined in claim 1, wherein, an air interlayer is provided respectively between said antenna circuit of said inner bottom surface of said lower cover and said ceramic layer as well as said matching electric circuit board layer and said main electric circuit board.

3. A hidden antenna device of a mobile phone as defined in claim 1, wherein, said antenna circuit of said inner bottom surface of said lower cover is a low frequency electric circuit for transmitting and receiving signals, while said matching electric circuit board layer is a high frequency electric circuit for transmitting and receiving signals.

* * * * *